US011473367B2

(12) United States Patent
Lu et al.

(10) Patent No.: US 11,473,367 B2
(45) Date of Patent: Oct. 18, 2022

(54) SHUTTER

(71) Applicants: LITE-ON ELECTRONICS (GUANGZHOU) LIMITED, Guangzhou (CN); LITE-ON TECHNOLOGY CORPORATION, Taipei (TW)

(72) Inventors: Tien-Sheng Lu, Taipei (TW); Yu-Chung Wu, Taipei (TW)

(73) Assignees: LITE-ON ELECTRONICS (GUANGZHOU) LIMITED; LITE-ON TECHNOLOGY CORPORATION

( * ) Notice: Subject to any disclaimer, the term of this patent is extended or adjusted under 35 U.S.C. 154(b) by 483 days.

(21) Appl. No.: 16/262,187

(22) Filed: Jan. 30, 2019

(65) Prior Publication Data

US 2019/0234136 A1 Aug. 1, 2019

(30) Foreign Application Priority Data

Jan. 31, 2018 (CN) ..... 201810097238.9

(51) Int. Cl.

| | |
|---|---|
| ***E06B 7/092*** | (2006.01) |
| ***E06B 7/10*** | (2006.01) |
| ***F24F 7/013*** | (2006.01) |
| ***E06B 7/086*** | (2006.01) |
| ***E06B 7/02*** | (2006.01) |
| ***E06B 7/28*** | (2006.01) |
| ***E06B 7/096*** | (2006.01) |

(52) U.S. Cl.

CPC ..... *E06B 7/092* (2013.01); *E06B 7/086* (2013.01); *E06B 7/096* (2013.01); *E06B 7/10* (2013.01); *E06B 7/28* (2013.01); *F24F 7/013* (2013.01); *E06B 2007/023* (2013.01)

(58) Field of Classification Search

CPC ... E06B 7/092; E06B 7/10; E06B 7/28; E06B 2007/023; E06B 7/096; E06B 7/086; E06B 7/02; E06B 7/14; F24F 7/013

USPC ..... 454/211

See application file for complete search history.

(56) References Cited

U.S. PATENT DOCUMENTS 2,725,726 A * 12/1955 Swanson ..... A47F 3/0447 62/89

3,149,476 A * 9/1964 Beckwith ..... A47F 3/0447 62/256

(Continued)

FOREIGN PATENT DOCUMENTS

CN 2499560 Y 7/2002

CN 1570341 A * 1/2005

(Continued)

*Primary Examiner* — Edelmira Bosques

*Assistant Examiner* — Frances F. Hamilton

(74) *Attorney, Agent, or Firm* — Innovation Counsel LLP

(57) ABSTRACT

A shutter includes a window frame, a plurality of blade structures, an intake driving unit and an airflow guiding unit. The window frame has an upper frame portion, a lower frame portion and two side frame portions. The blade structures are disposed on the window frame, and each has a through hole and a plurality of outlets. The intake driving unit is disposed in the upper frame portion. The airflow guiding unit is disposed in at least one of the two side frame portions. Each of the through holes of the blade structures communicates with the inside of at least one of the two side frame portions.

15 Claims, 17 Drawing Sheets

(56) References Cited

U.S. PATENT DOCUMENTS 3,157,105 A * 11/1964 Tamm ..... F24F 9/00 454/192
3,205,541 A * 9/1965 Beards ..... E06B 7/084 49/371
4,050,364 A * 9/1977 Maus ..... F24F 7/00 181/224
4,294,038 A * 10/1981 Davidson ..... F24D 11/007 49/63
4,466,254 A * 8/1984 Karashima ..... A47F 3/0447 454/193
4,899,647 A * 2/1990 Garries ..... F24F 13/08 454/359
7,037,189 B2 * 5/2006 Ohwada ..... F24F 9/00 454/191
7,641,545 B2 * 1/2010 Chen ..... E06B 7/02 126/633
8,251,406 B2 * 8/2012 Kawano ..... F15D 1/04 285/179
10,267,087 B2 * 4/2019 Takada ..... E06B 3/66
10,337,238 B1 * 7/2019 Crittenden ..... E06B 7/082
2004/0253917 A1 * 12/2004 Kim ..... F24F 13/18 454/200
2014/0020852 A1 * 1/2014 Thielemann ..... F24S 10/502 160/127
2015/0368960 A1 * 12/2015 Horn ..... E06B 7/10 454/211
2017/0038085 A1 * 2/2017 Kawano ..... A47L 9/02
2017/0191309 A1 * 7/2017 Takada ..... E06B 7/10

FOREIGN PATENT DOCUMENTS

CN 103403462 A * 11/2013 ..... F24F 13/18
CN 103429836 A 12/2013
CN 204531999 U * 8/2015
CN 106013538 A * 10/2016 ..... E04B 2/88
CN 107208415 A * 9/2017 ..... E04B 1/74
CN 108119034 A * 12/2017
CN 107605382 A * 1/2018
CN 108119034 A * 6/2018 ..... E06B 7/02
DE 0087486 A1 * 9/1983
DE 20105297 U1 * 6/2001 ..... E04F 10/10
EP 0112572 A1 * 12/1982
EP 0087486 A1 * 9/1983 ..... E06B 7/10
EP 2850272 B1 * 11/2016 ..... E06B 7/02
FR 2253909 A1 * 12/1973
GB 2202570 A * 9/1988 ..... E06B 7/084
JP 5842194 B1 * 1/2016 ..... E04B 2/88
KR 20130059550 A * 7/2013 ..... F24F 3/02
TW M376240 U 3/2010
TW 201420870 A 6/2014
WO 2016166694 A1 10/2016

* cited by examiner

SHUTTER

This application claims the benefit of People's Republic of China application Serial No. 201810097238.9, filed Jan. 31, 2018, the subject matter of which is incorporated herein by reference.

BACKGROUND OF THE INVENTION

Field of the Invention

The invention relates in general to a light blocker of a building, and more particularly to a shutter and a blade structure thereof.

Description of the Related Art

Normally, shutters or glass plates can be configured on the window structures of a building to assure a good effect of daylighting and ventilation for public places or private households. When the shutters or the glass plates are open, outdoor air and indoor air are ventilated. However, when it rains, the shutters or the glass plates are tightly closed to avoid rainwater infiltrating into the indoors, but the indoors will become hot and unventilated. On the other hand, when the shutters or the glass plates are open, insects may infiltrate into the indoors from the outdoors. Although the screen window can be installed to prevent the infiltration of insects, the screen window not only has the problem of rupture and dust, but also blocks the view and spoils the aesthetics of the building.

Therefore, how to provide a shutter capable of preventing the infiltration of rainwater and insects and at the same time ventilating the outdoor air and the indoor air has become a prominent task for the industries.

SUMMARY OF THE INVENTION

The present disclosure relates to a shutter capable of preventing the infiltration of rainwater and insects without installing any screen window and/or fan.

According to one embodiment of the invention, a shutter including a window frame, a plurality of blade structures, an intake driving unit and an airflow guiding unit. The window frame has an upper frame portion, a lower frame portion and two side frame portions. The blade structures are movably disposed on the window frame, and have through holes and a plurality of outlets. The intake driving unit is disposed in the upper frame portion. The airflow guiding unit is disposed in at least one of the two side frame portions. Each of the through holes of the blade structures communicates with the inside of at least one of the two side frame portions.

The above and other aspects of the invention will become better understood with regard to the following detailed description of the preferred but non-limiting embodiment(s). The following description is made with reference to the accompanying drawings.

DETAILED DESCRIPTION OF THE INVENTION

Figure 1A:
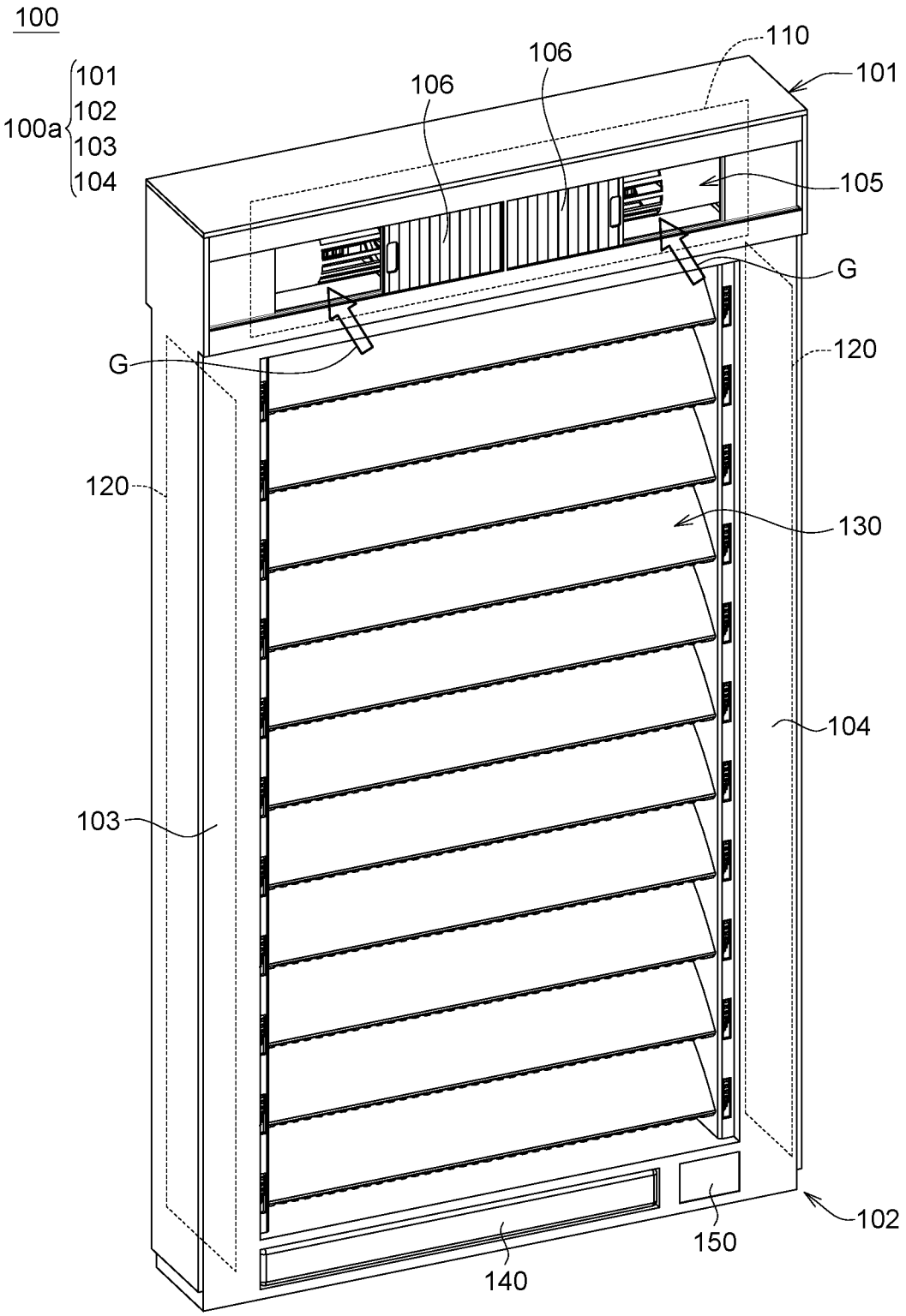
FIGS. 1A and 1B respectively are an external view and an explosion diagram of a shutter according to an embodiment of the present invention.
Figure 1B:
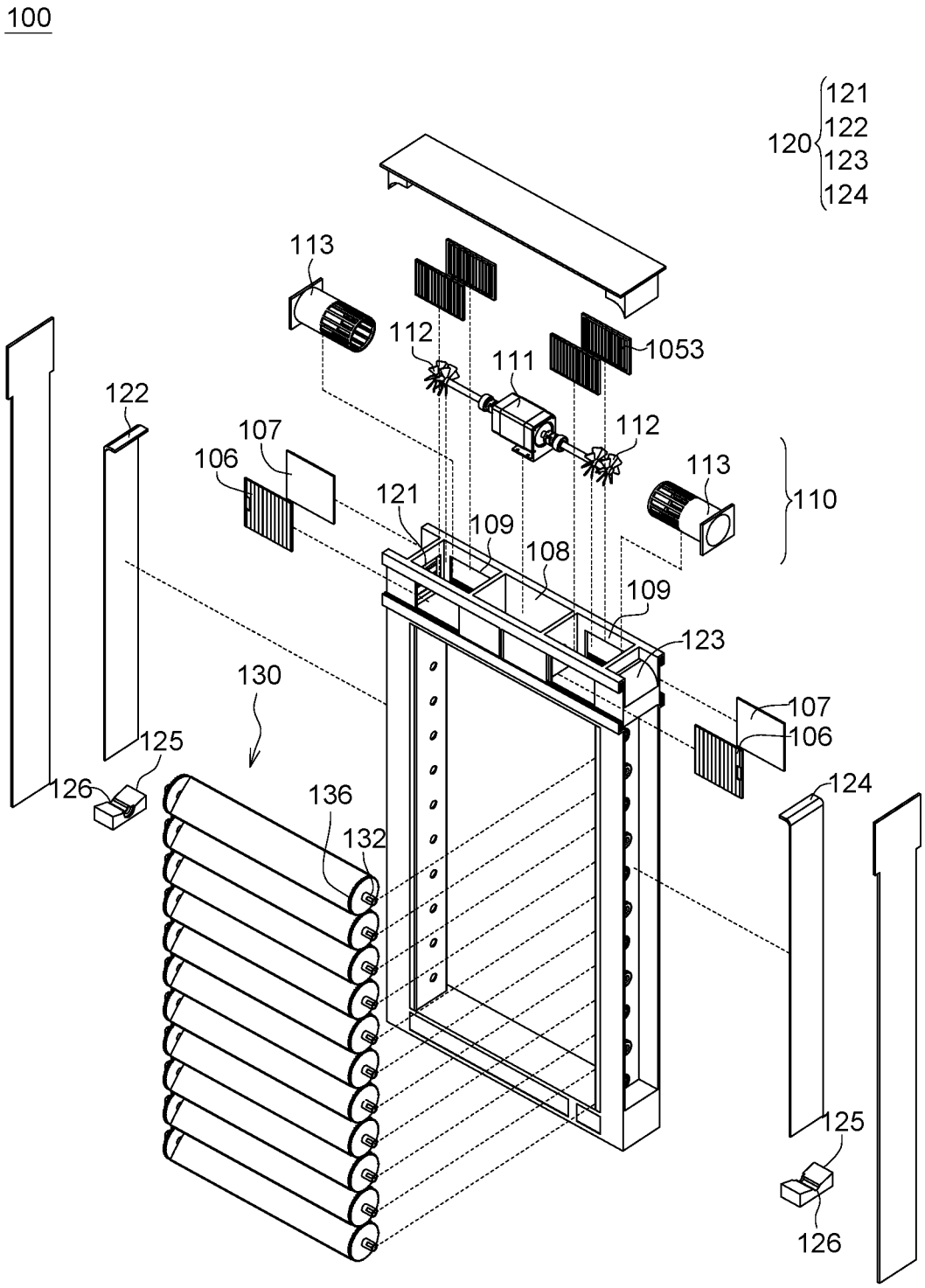

The shutter of the present invention is an assembly module configured at a window structure of a building. The shutter includes a window frame and a plurality of blade structures. FIGS. 1A and 1B respectively are an external view and an explosion diagram of a shutter 100 according to an embodiment of the present invention. As indicated in FIGS. 1A and 1B, the shutter 100 includes a window frame 100*a* and a plurality of blade structures 130. The window frame 100*a* has an upper frame portion 101, a lower frame portion 102, a left frame portion 103 and a right frame portion 104. The upper frame portion 101 of the shutter 100 has at least one air inlet 105 and at least one intake driving unit 110 for providing an inlet gas G. The intake driving unit 110 includes at least one motor 111 and at least one fan blade 112. Two side frame portions (the left frame portion 103 and the right frame portion 104) of the shutter 100 respectively have an airflow guiding unit 120 for guiding the inlet gas G to each blade structure 130. Furthermore, the lower frame portion 102 of the shutter 100 further includes a power unit 140 for providing necessary power to electronic components (such as blade driving unit, environment sensor, computation control unit, communication unit, and intake control unit). Also, the shutter 100 further includes at least one sensor 150 for detecting the conditions of indoor or outdoor environments, such as temperature, humidity, and concentration of carbon dioxide in the air. Moreover, the shutter 100 further includes a communication unit and a computation control unit (not illustrated). The user may perform remote control though the communication unit and the computation control unit, such as switching the operation mode, regulating the intake of the inlet gas G or accessing the detection results of the sensor 150.

According to an embodiment of the present invention, the shutter 100 further includes a blade driving unit (not illustrated), such as a motor, a gear set, a connecting rod and other transmission component. The blade driving unit is for driving the blade structures 130 of the shutter 100 so as to rotate and fix the blade structures 130 at a predetermined orientation, such that the blade structures 130 can face the indoors or the outdoors or enters a horizontal state, an inclined state or a vertical state. Moreover, the blade driving unit can be powered by the power unit 140. The power unit 140 includes a battery module or a solar power module or a mains power supply module.

Figure 2A:
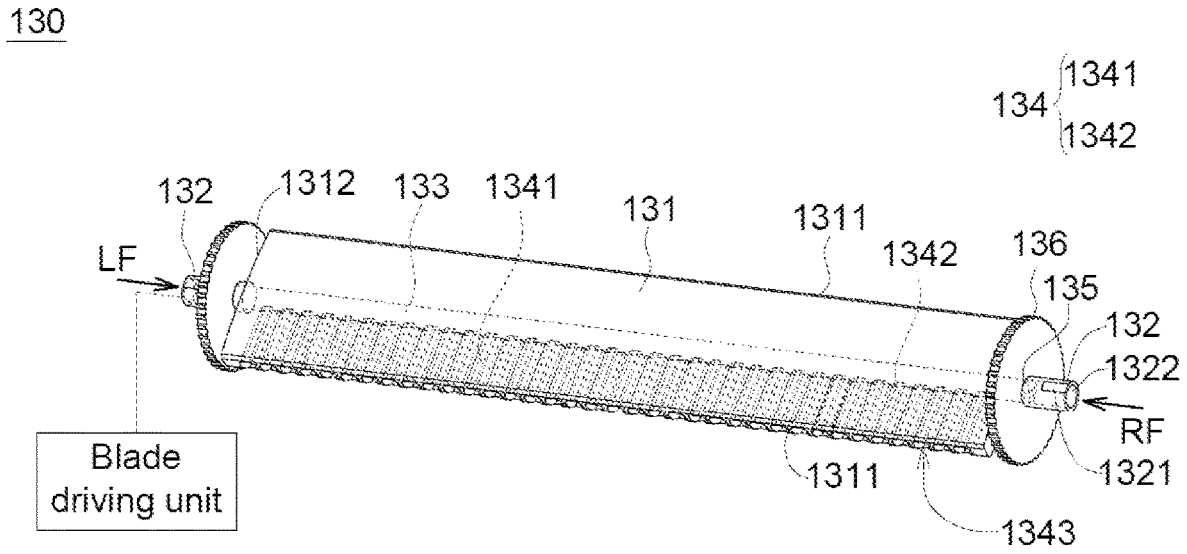
FIG. 2A is a schematic diagram of a blade structure of a shutter according to an embodiment of the present invention.
Figure 2B:
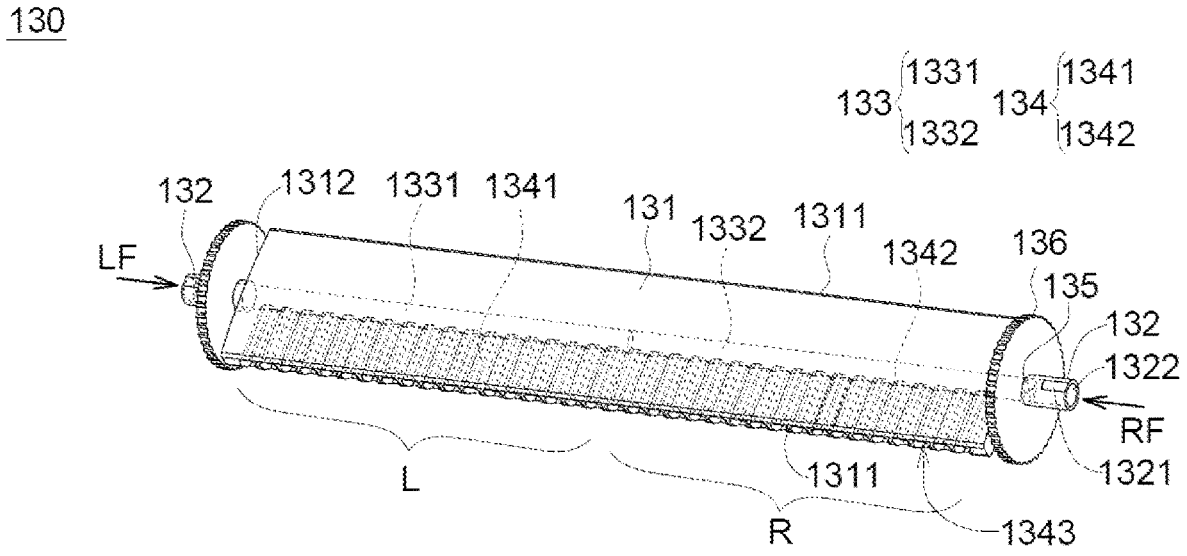
FIGS. 2B and 2C respectively are a schematic diagram and a partial enlargement of a blade structure of a shutter according to an embodiment of the present invention.
Figure 2C:
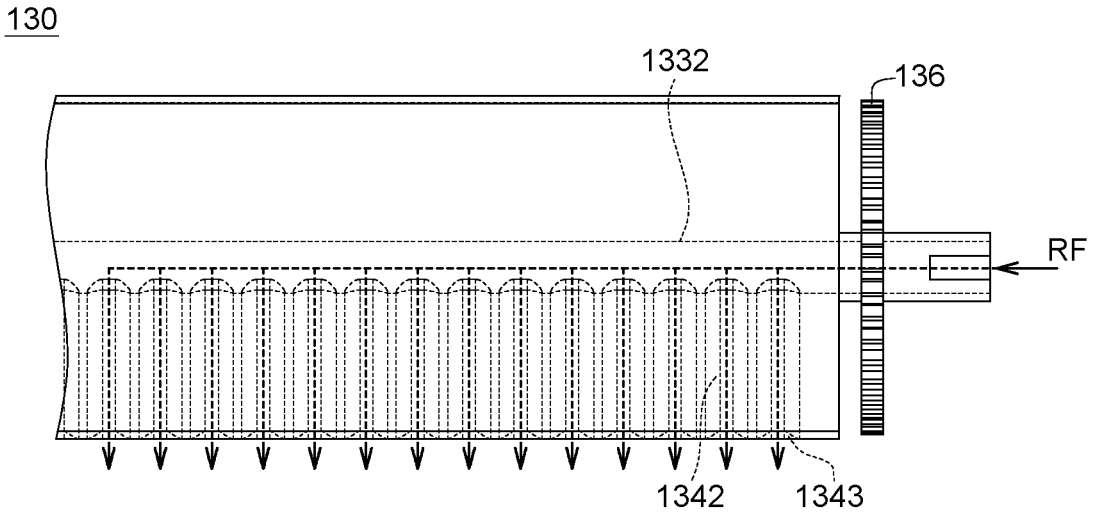

Each blade structure of the present invention includes a body and a shaft connection portion. The body includes at least one main channel and a plurality of branch channels. FIGS. 2A and 2B respectively are schematic diagrams of a blade structure 130 of a shutter according to an embodiment of the present invention. FIG. 2C is a partial enlargement of a blade structure 130. As indicated in FIGS. 2A and 2B, the blade body 131 has at least one main channel 133 and a plurality of branch channels 134. The main channel 133 connects the through holes 1322 of the shaft connection portion 132, such that the air can enter the blade structures 130 via the through holes 1322. Moreover, the blade structures 130 further includes a regulator for regulating the aperture size of the main channel 133 or the aperture sizes of the through holes 1322. Additionally, alternative blade structures 130 further includes a channel regulating structure capable of changing the angle between a main channel 137 and branch channels 138. The channel regulating structure can be horizontally adjusted towards different directions to change the wind outlet angle of the branch channels 138.

Detailed descriptions of the invention are disclosed below with a number of embodiments. However, the disclosed embodiments are for explanatory and exemplary purposes only, not for limiting the scope of protection of the invention. Similar/identical designations are used to indicate similar/identical elements.

Refer to FIGS. 1A, 2A and 2B. The blade structure 130 of the shutter 100 according to an embodiment of the present invention includes a body 131 and shaft connection portions 132. In the present embodiment, the body 131 is an elongated plate and has two opposite first side surfaces 1312 and two opposite second side surfaces 1311. The shaft connection portions 132 are disposed on the first side surfaces 1312, and at least one of shaft connection portions 132 can have through holes 1322. Besides, the shaft connection portion 132 have latches 1321 for fixing the blade structure 130 on the left frame portion 103 and the right frame portion 104 of the shutter 100 (that is, on two side frame portions).

In an embodiment, the main channel 133 of the body 131 passes through at least one first side surface 1312, and extends along the major axis of the body 131. As indicated in FIG. 2A, one end of the main channel 133 passes through the left first side surface 1312 of the body 131, and extends along the major axis of the body 131. In the present embodiment, depending on the user's needs, the main channel 133 may or may not pass through the right first side surface 1312 of the body 131. Preferably the main channel 133 does not pass through the right first side surface 1312 of the body 131 to avoid the airflows entering the main channel 133 via the two ends of the main channel 133 and interfering with each other. When the airflows interfere with each other, the airflow pressure will be reduced. Furthermore, the branch channels 134 of the body 131 may extend along the minor axis of the body 131 and communicate with the main channel 133. Thus, the inlet gas can enter the main channel 133 via the through holes 1322 of the shaft connection portion 132 so as to be distributed to a plurality of branch channels 134 via the main channel 133, such that the inlet gas can be uniformly ventilated via a plurality of outlets 1343 formed on the second side surface 1311 of the blade body 131.

Refer to FIG. 2B. In an embodiment, to reduce the length of the main channel 133 such that the channel will not be too long and slow down the velocity of the airflow, the main channel 133 includes a first main channel 1331 and a second main channel 1332. The first main channel 1331 communicates with a plurality of corresponding first branch channels 1341, such that the inlet gas can smoothly enter the left half part L of each blade structure 130 from the left frame portion 103. The second main channel 1332 communicates with a plurality of corresponding second branch channels 1342, such that the inlet gas can smoothly enter the right half part R of each blade structure 130 from the right frame portion 104. As indicated in FIG. 2B, the first main channel 1331 and the second main channel 1332 have an equivalent length and an equivalent number of branch channels, and are respectively disposed on the left half part L and the right half part R of each blade structure 130 and are separated from each other. In some unillustrated embodiments, the first main channel and the second main channel may have different lengths and different numbers of branch channels, and are all within the scope of the present invention.

In an embodiment, the first main channel 1331 passes through a first side surface 1312 of the body 131. In an embodiment, the blade structure 130 further includes a hard tube (not illustrated). The hard tube is disposed in body 131 and passes through the main channel 133 and the shaft connection portion 132 to provide a better structural strength. Meanwhile, the hard tube has openings formed on the lateral side to communicate with the branch channels. The hard tube and the shaft connection portion 132 can be integrally formed in one piece or separately formed as different elements. In another embodiment, the body 131 of each blade structure 130 can be realized by two thin slices formed of wood, plastic or a lightweight metal (such as aluminum). The two thin slices can be formed with upper grooves and lower grooves whose shape matches that of the upper grooves. Then, the two thin slices are combined to form the blade body 131 whose inside includes the main channel 133 and the branch channels 134. In another unillustrated embodiment, the blade structure can be realized by two thin slices clamping a hard tube having a plurality of holes, and partitions can be interposed between the holes to form the branch channels.

Figure 2D:
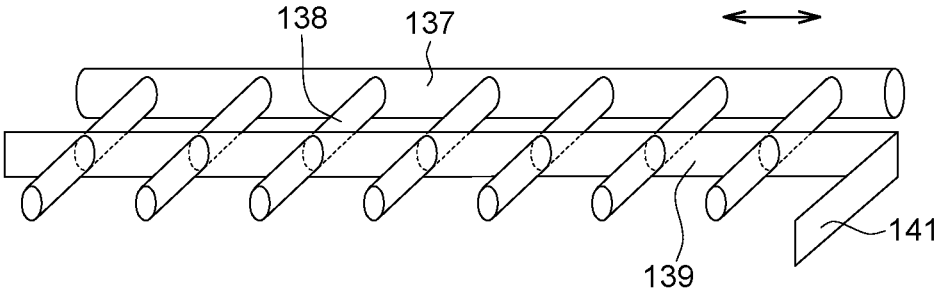
FIG. 2D is a schematic diagram of a channel regulating structure according to an embodiment of the present invention.

In the present invention, the angle between the main channel and the branch channels is not subjected to specific restrictions. For example, the angle can be equivalent to, larger than or smaller than 90°. Refer to FIG. 2D. According to another embodiment of the present invention, the blade structure of the present invention includes a channel regulating structure. The channel regulating structure includes a connecting rod 139 and a paddle 141. The channel structure includes a main tube to form the main channel 137 and a plurality of branch tubes to from the branch channels 138 which can be laterally moved and connected to the main channel 137. The branch channels 138 can be laterally moved with respect to the main channel 137 to change the angle between the main channel 137 and the branch channels 138. The connecting rod 139 connects the outer side of the branch channels 138, and the connecting rod 139 and the branch channels 138 can be laterally pulled through the paddle 141 to change the angle between the main channel 137 and the branch channels 138, such that the branch channels 138 can swing to the left or the right to change the angle of the branch channels 138.

Like previous embodiments where the main channel 137 and the branch channels 138 are formed of a hard tube and a plurality of partitions, the partitions can be connected to the connecting rod 139. When the connecting rod 139 is pulled, the angle between the partitions and the hard tube will be changed, so as to change the angle of the branch channels 138.

Figure 3A:
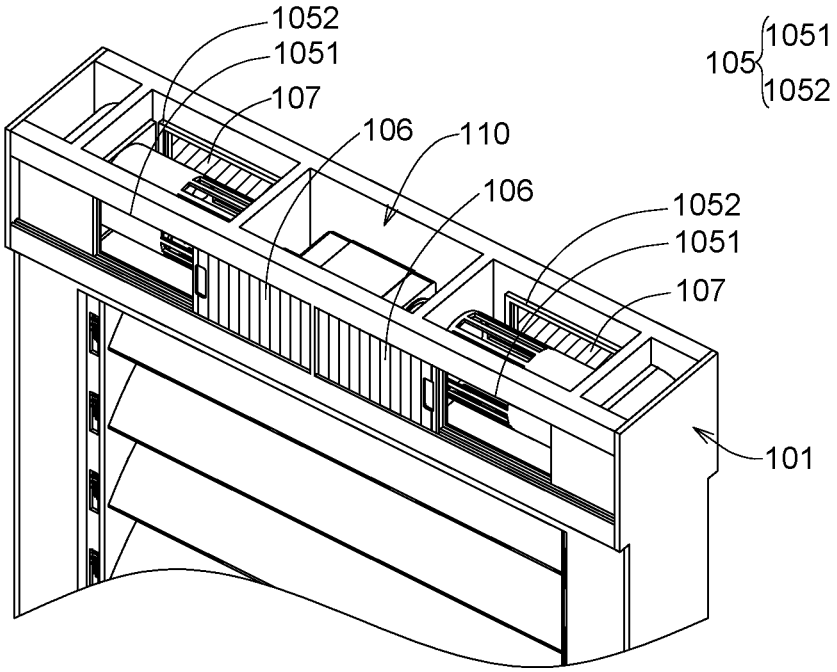
FIGS. 3A-3C respectively are schematic diagrams of movable door panels for regulating indoor and outdoor intakes.
Figure 3B:
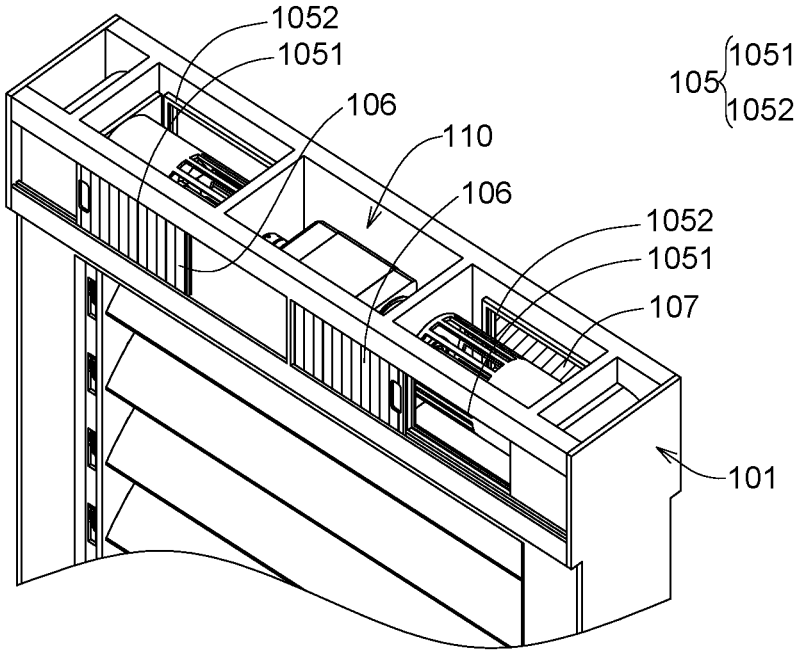
Figure 3C:
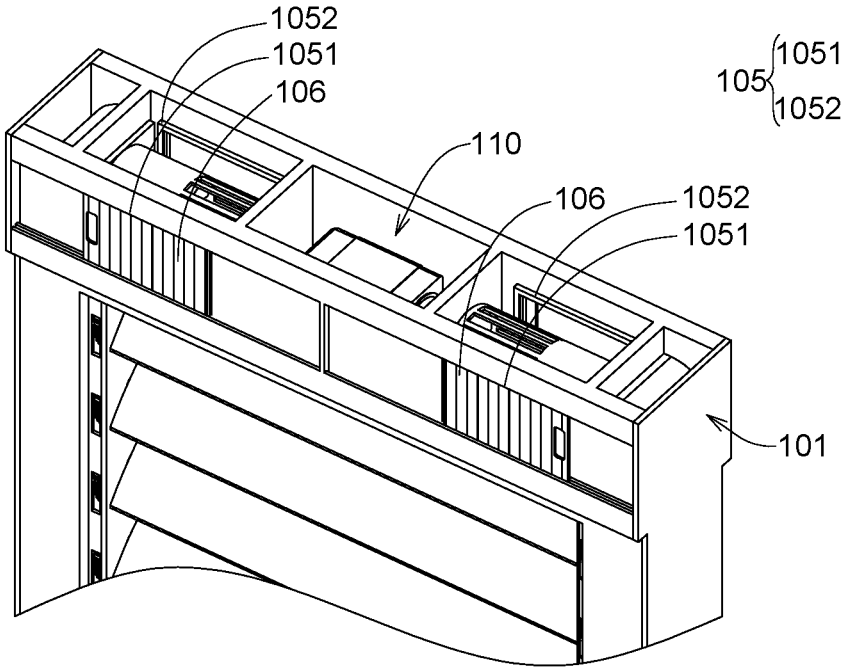
Figure 4A:
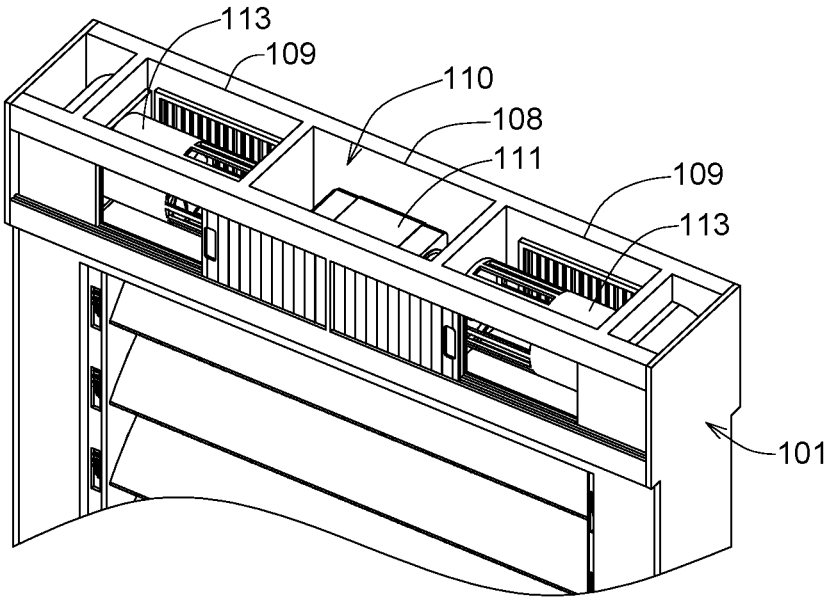
FIGS. 4A-4C respectively are schematic diagrams of an intake driving unit according to an embodiment of the present invention.
Figure 4B:
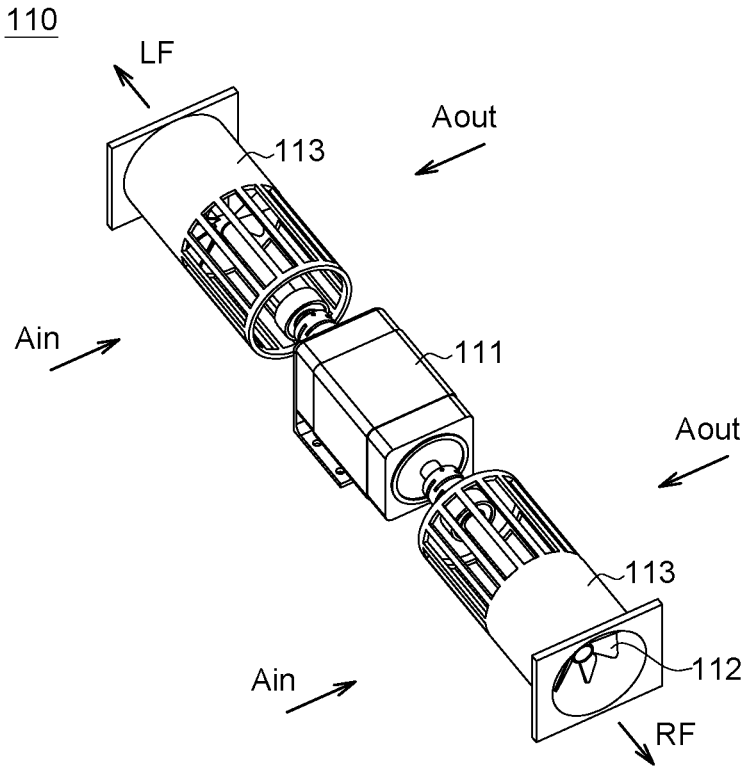
Figure 4C:
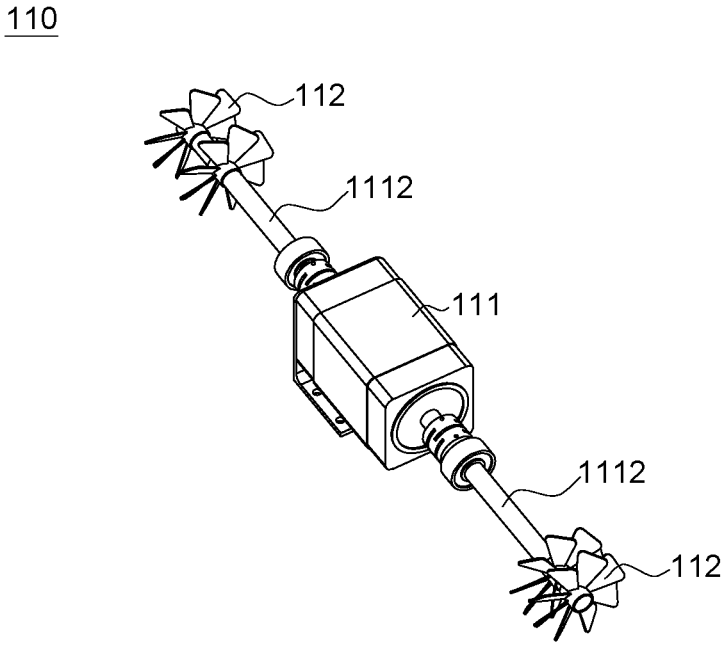

FIGS. 3A-3C respectively are schematic diagrams of movable door panels 106 and 107 for regulating indoor and outdoor intakes. FIGS. 4A-4C respectively are schematic diagrams of an intake driving unit 110 according to an embodiment of the present invention.

Figure 8A:
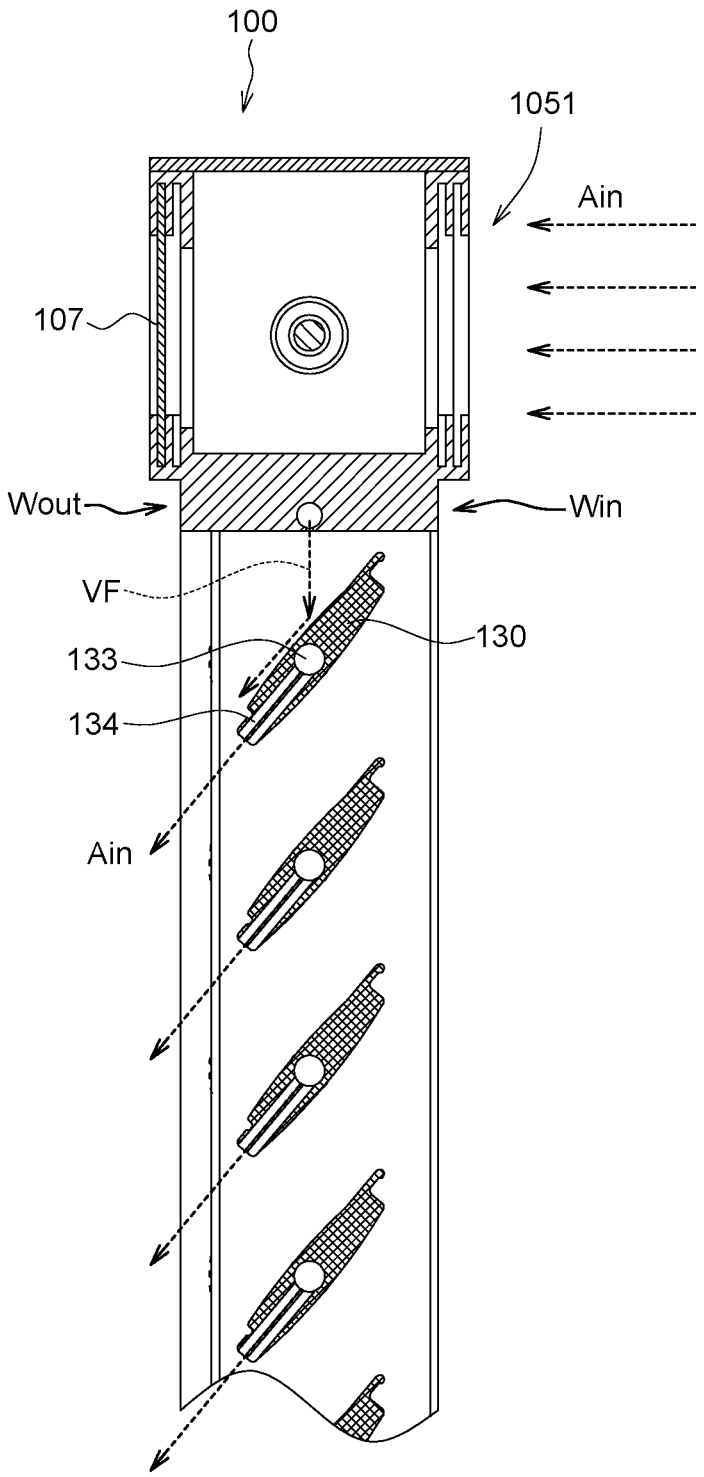
FIG. 8A is a schematic diagram of a dissipation mode in which the indoor air is dissipated to the outdoors to prevent the infiltration of rainwater and insects according to an embodiment of the present invention.
Figure 8B:
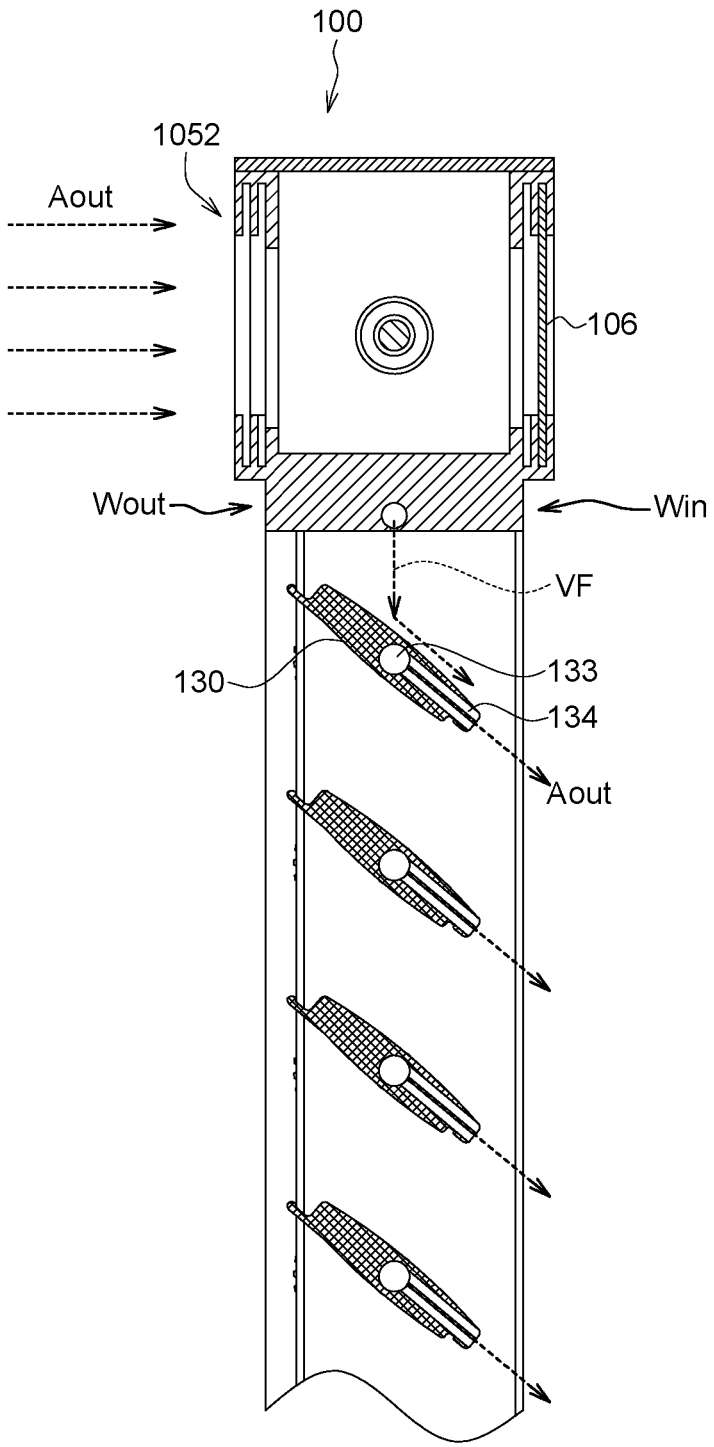
FIG. 8B is a schematic diagram of an infusing mode in which the outdoor air is infused to the indoors according to an embodiment of the present invention.

Refer to FIGS. 3A-3C. According to an embodiment of the present invention, a plurality of air inlets 105 are disposed in the upper frame portion 101 of the window frame for introducing the indoor air and/or the outdoor air. Besides, the movable door panels 106 and 107 are movably disposed in each air inlet 105 for regulating the intake of air. Furthermore, a filter 1053 (referring to FIG. 1B) can be disposed on the air inlet to block the dust or objects from infiltrating. The air inlets 105 include at least one interior air inlet 1051 and at least one exterior air inlet 1052. The at least one exterior air inlet 1052 faces the outdoors, and the at least one interior air inlet 1051 faces the indoors. Refer to FIG. 3A. When the movable door panels 106 disposed in the interior air inlets 1051 are fully opened but the movable door panels 107 disposed in the exterior air inlets 1052 are shut, the intake driving unit 110 introduces the indoor air to execute the dissipation mode as shown in FIG. 8A. Refer to FIG. 3B. When the movable door panel 106 disposed in one interior air inlet 1051 and the movable door panel 107 disposed in the exterior air inlet 1052 are opened but the movable door panel 106 disposed in another interior air inlet 1051 and the movable door panel 107 disposed in another exterior air inlet 1052 are shut, the intake driving unit 110 introduces some indoor air and some outdoor air at the same time to execute the exchanging mode of 50% of the indoor air and 50% of the outdoor air. Meanwhile, the blades work with the intake driving unit 110 to infuse the air towards the indoors. Referring to FIG. 3C. When the movable door panels 107 disposed in the exterior air inlets 1052 are opened but the movable door panels 106 disposed in the interior air inlets 1051 are fully shut down, the intake driving unit 110 introduces the outdoor air to execute the infusing mode as shown in FIG. 8B. Thus, the intake of the indoor air and the intake of the outdoor air can be adjusted through the movable door panels 106 and 107. For example, the intake of the indoor air and the intake of the outdoor air can be adjusted to be 100% of the indoor air, 50% of the indoor air and 50% of the outdoor air, or 100% of the outdoor air. The movable door panels 106 and 107 can be automatically opened or shut down by a slider driven by electricity or hydraulic pressure. The shutter 100 of the present embodiment can correspondingly open or shut down the movable door panels 106 and 107 according to the detection results of the indoor/outdoor sensor 150, and relevant operations are disclosed below.

Refer to FIGS. 4A-4C. According to an embodiment of the present invention, the intake driving unit 110 is disposed in the upper frame portion 101 of the window frame. The upper frame portion 101 includes a sealed chamber 108 and two intake regulating chambers 109. The sealed chamber 108 is interposed between the intake regulating chambers 109. Moreover, the intake driving unit 110 includes a motor 111 and two sets of fan blades 112. The two sets of fan blades 112 are disposed on the shaft 1112 of the motor 111. The motor 111 is for driving the two sets of fan blades 112 to rotate and introduce the indoor air Ain and/or the outdoor air Aout.

According to an embodiment of the present invention, the motor 111 of the intake driving unit 110 is disposed in the sealed chamber 108, and the two sets of fan blades 112 of the intake driving unit 110 respectively are disposed in the two intake regulating chambers 109. Besides, the sealed chamber 108 is interposed between the two intake regulating chambers 109. The sealed chamber 108 is waterproof and has sound insulation effect, and therefore can protect the motor 111 or the drive circuit and reduce the noises. Additionally, a partially hollowed wind mask 113 can be disposed surrounding the two sets of fan blades 112 to avoid objects or insects being sucked into the wind mask 113. When the indoor air Ain or outdoor air Aout is introduced to the wind mask 113, the two sets of fan blades 112 can drive the inlet gas to flow along the axial direction of the fan blade 112 to form a left-hand side airflow LF and a right-hand side airflow RF. In an embodiment, the left-hand side airflow LF flows to the left frame 103, and the right-hand side airflow RF flows to the right frame 104.

Figure 5A:
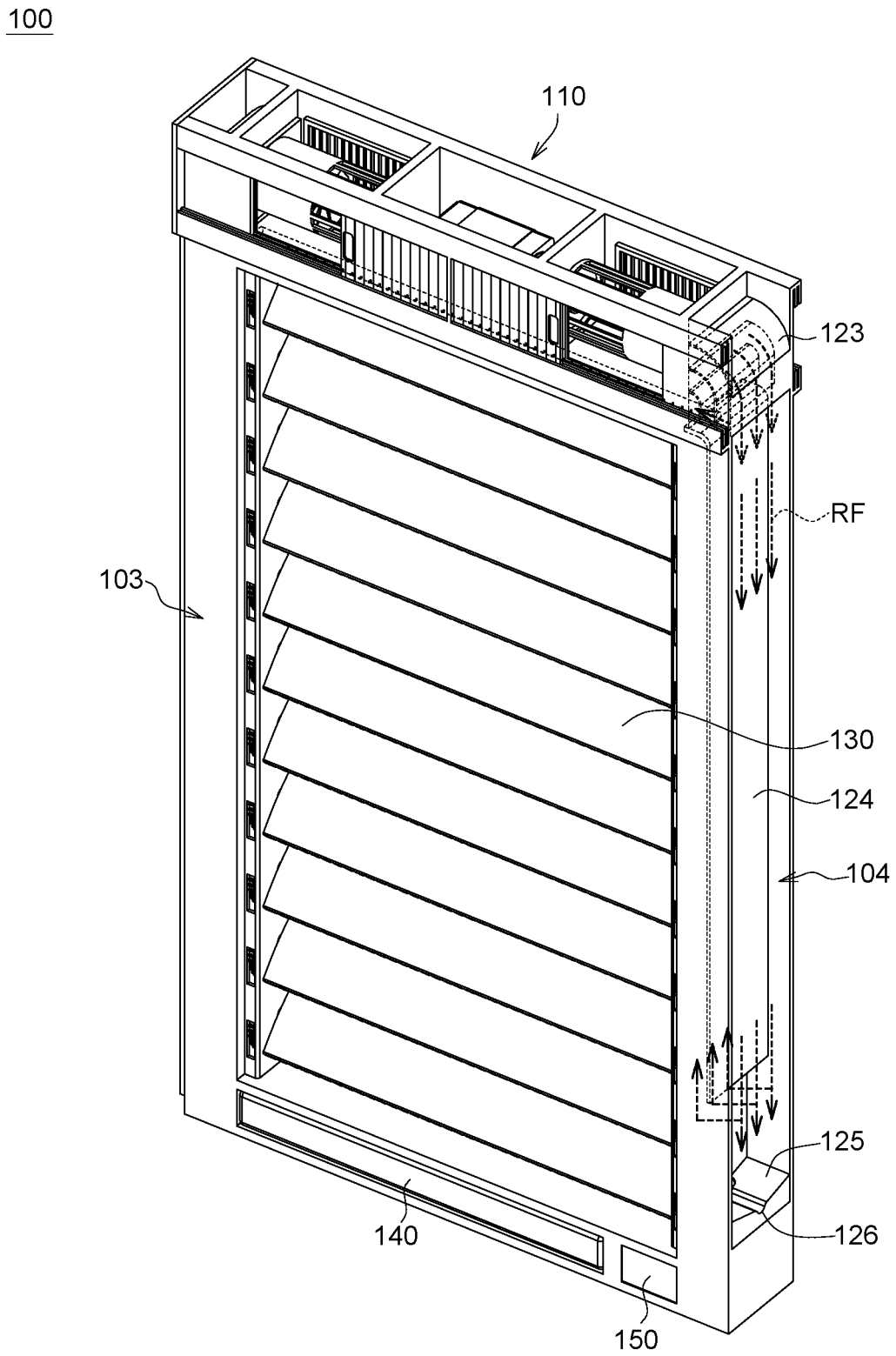
FIG. 5A and FIG. 5B respectively are schematic diagrams of the airflow guiding units according to an embodiment of the present invention.
Figure 5B:
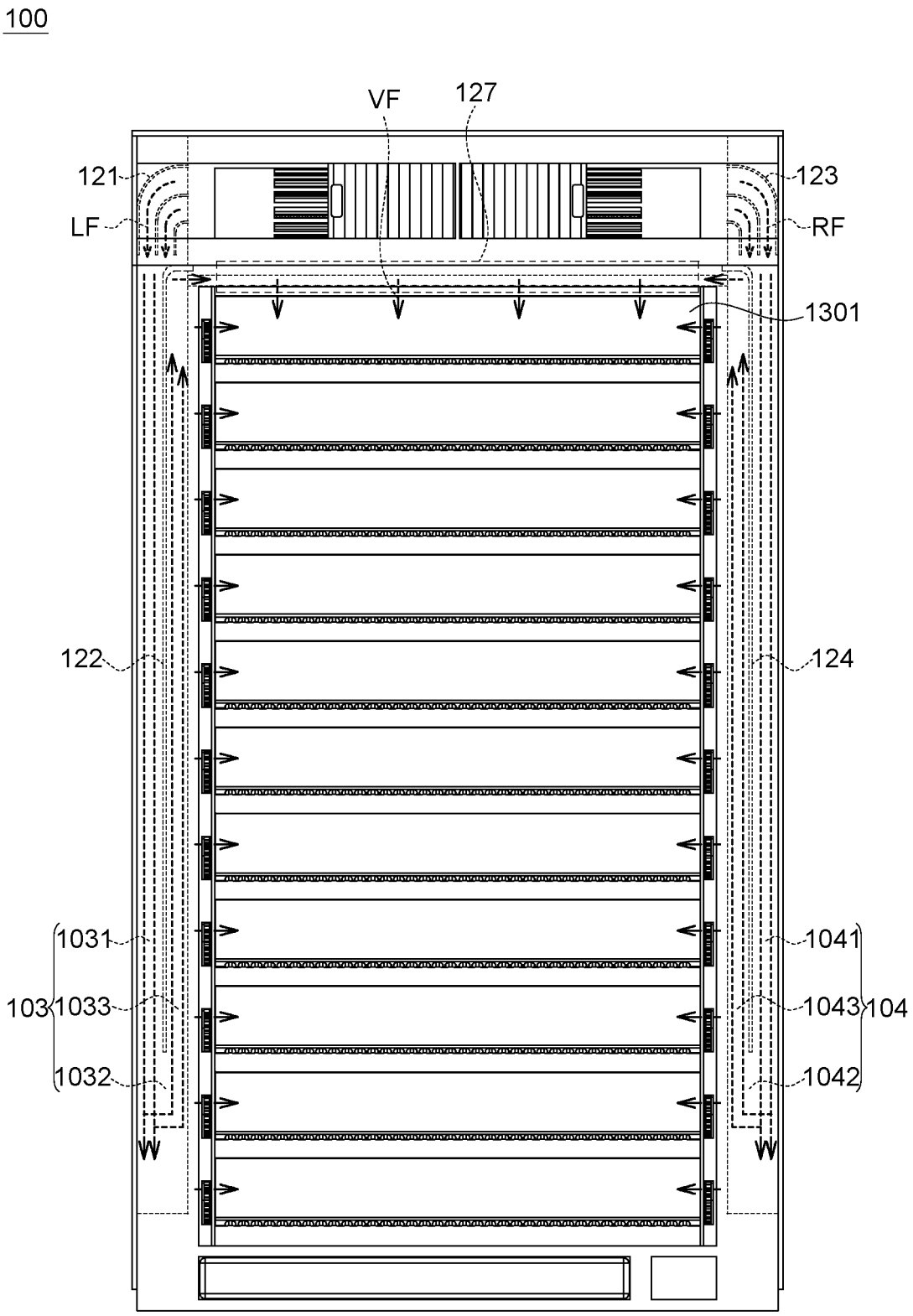
Figure 5C:
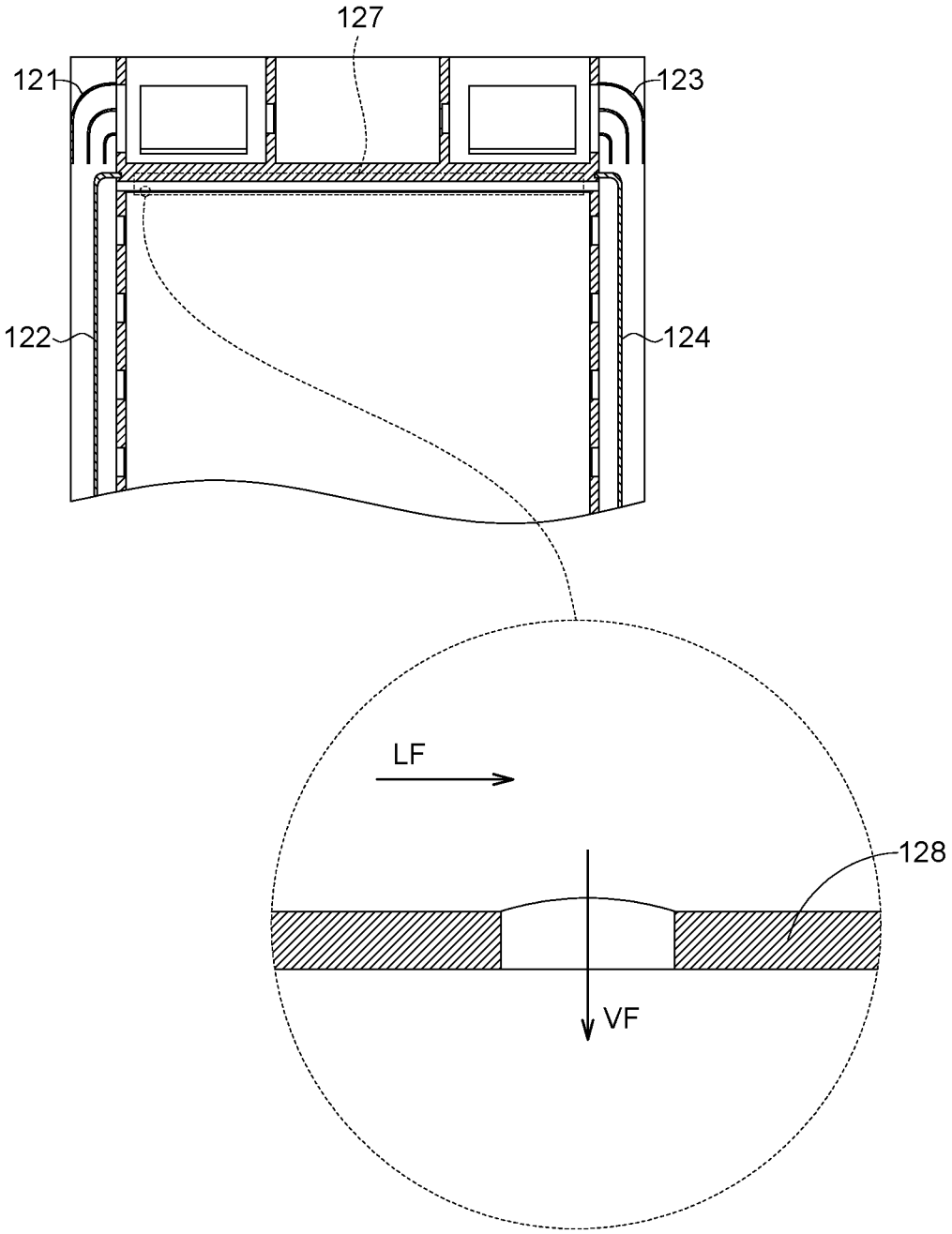
FIG. 5C is a cross-sectional view and a partial enlargement of a vertical type airflow guiding unit according to an embodiment of the present invention.
Figure 6A:
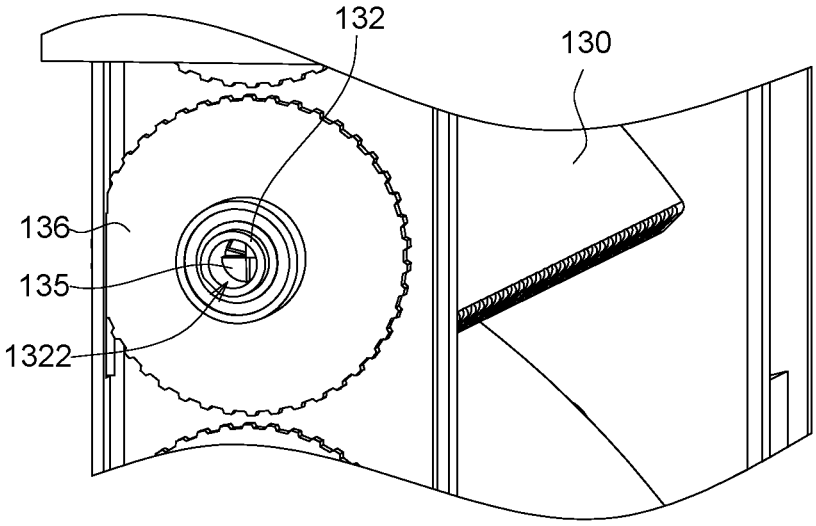
FIGS. 6A and 6B respectively are schematic diagrams of a regulator for regulating the intake according to an embodiment of the present invention.
Figure 6B:
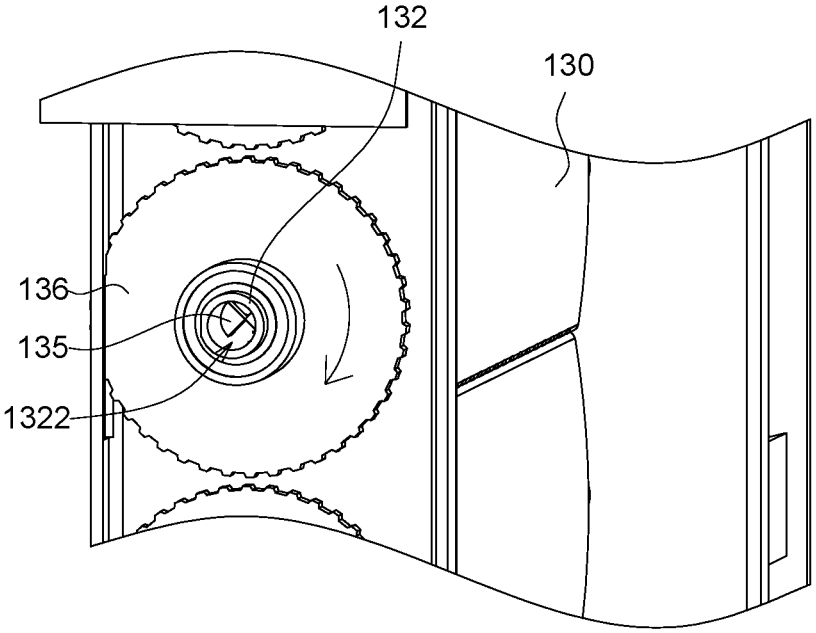

FIG. 5A and FIG. 5B respectively are schematic diagrams of the airflow guiding units 120 according to an embodiment of the present invention. FIG. 5C is a cross-sectional view and a partial enlargement of a vertical type airflow guiding unit 127 according to an embodiment of the present invention. FIGS. 6A and 6B respectively are schematic diagrams of a regulator for regulating the air inflow according to an embodiment of the present invention.

The airflow guiding unit 120 is disposed in at least one of the two side frame portions of the window frame. Refer to FIGS. 1A and 5A-5C. According to an embodiment of the present invention, the airflow guiding units 120 are disposed in the left frame 103 and the right frame 104 respectively for guiding the inlet gas to smoothly pass through the left frame portion 103 and the right frame portion 104 to enter each blade structure 130. The airflow guiding unit 120 disposed in the left frame portion 103 includes a first partition plate 122, and preferably further includes a first arced plate 121. The airflow guiding unit 120 disposed in the right frame portion 104 includes a second partition plate 124, and preferably further includes a second arced plate 123. The first arced plate 121 is disposed at one end of the upper frame portion 101 connected to the left frame 103 for guiding the left-hand side airflow LF to enter the left frame 103 from the upper frame portion 101. The first partition plate 122 is disposed under the first arced plate 121 and downwardly extends to the left frame 103, such that the left-hand side airflow LF can move downwardly along the outer side of the first partition plate 122. Moreover, the second arced plate 123 is disposed at one end of the upper frame portion 101 connected to the right frame 104 for guiding the right-hand side airflow RF to enter the right frame 104 form the upper frame portion 101. The second partition plate 124 is disposed under the second arced plate 123 and downwardly extends to the right frame 104, such that the right-hand side airflow RF can move downwardly along the outer side of the second partition plate 124.

According to an embodiment of the present invention, the inner space of the left frame 103 can be compartmentalized into an airflow sinking chamber 1031, an airflow turning chamber 1032 and an airflow rising chamber 1033 with respect to the first partition plate 122. The airflow sinking chamber 1031 is separated from the airflow rising chamber 1033 by the first partition plate 122. That is, the airflow sinking chamber 1031 is located at the outer side of the first partition plate 122; the airflow rising chamber 1033 is located at the inner side of the first partition plate 122; and the airflow turning chamber 1032 is located under the first partition plate 122 and connects the airflow sinking chamber 1031 and the airflow rising chamber 1033. Since the airflow sinking chamber 1031 and the airflow rising chamber 1033 are separated by the first partition plate 122, the left-hand side airflow LF can sequentially pass through the airflow sinking chamber 1031, the airflow turning chamber 1032 and the airflow rising chamber 1033 to enter the left half L of each blade structure 130. Similarly, inner space of the right frame 104 can be compartmentalized into an airflow sinking chamber 1041, an airflow turning chamber 1042 and an airflow rising chamber 1043 with respect to the second partition plate 124. The relative relationship between the chambers and the circulation of the airflow are the same as disclosed above and omitted here.

Refer to FIGS. 5B and 5C. According to an embodiment of the present invention, the shutter 100 further includes a vertical type airflow guiding unit 127 interposed between the upper frame portion 101 and the topmost blade structure 1301 for providing a vertical airflow VF. The vertical type airflow guiding unit 127 communicates with the airflow rising chamber 1033 in the left frame portion 103 and the airflow rising chamber 1043 in the right frame portion 104, such that the left-hand side airflow LF and the right-hand side airflow RF can enter the vertical type airflow guiding unit 127 after passing through the airflow rising chambers 1033 and 1043 respectively. In an embodiment, the vertical type airflow guiding unit 127 includes, for example, a porous plate 128, through which the left-hand side airflow LF and the right-hand side airflow RF pass and move downwardly to form a vertical airflow VF. The vertical airflow VF prevents rainwater or insects from entering the indoors via the gap between the upper frame portion 101 and the topmost blade structure 1301.

Refer to FIGS. 5B, 6A and 6B. According to an embodiment of the present invention, the shaft connection portion 132 of each blade structure 130 is disposed into the two side frame portions, and the through holes 1322 of each shaft connection portion 132 communicate with the airflow rising chambers 1033 and 1043. Thus, the left-hand side airflow LF and the right-hand side airflow RF can enter each blade structure 130 in a manner from the bottom side to the upper side of the shutter 100. In an embodiment of the present invention, a regulator is disposed on the shaft connection portion 132 of each blade structure 130 for regulating the volume of the airflow entering each blade structure 130. The regulator can be realized by an aperture regulator. The regulator includes a stopper 135 and a rotation piece 136 for controlling the position of the stopper 135 in the through holes 1322 to adjust the size of the aperture in the main channel 133 or the through holes 1322. The larger the area of the through holes 1322 being blocked by the stopper 135, the smaller the opening of the through holes 1322. Conversely, the smaller the area of the through holes 1322 being blocked by the stopper 135, the larger the opening of the through holes 1322.

When the airflow enters the blade structures 130 in a manner from the bottom side to the upper side of the shutter 100, the airflow firstly enters the blade structures 130 at the bottom, so as to cause the volume of the airflow entering the blade structures 130 at the top too small. In an embodiment, the above problem of the volume of the airflow entering the blade structures 130 at the top being too small can be resolved by adjusting the aperture sizes of the main channel 133 or the through holes 1322 with respect to different blade structures 130 (for example, the aperture sizes sequentially increase in a manner from the bottom side to the upper side of the shutter 100). The regulators can also be realized by different implementations or disposed at other positions, and the present invention is not limited thereto.

Figure 7:
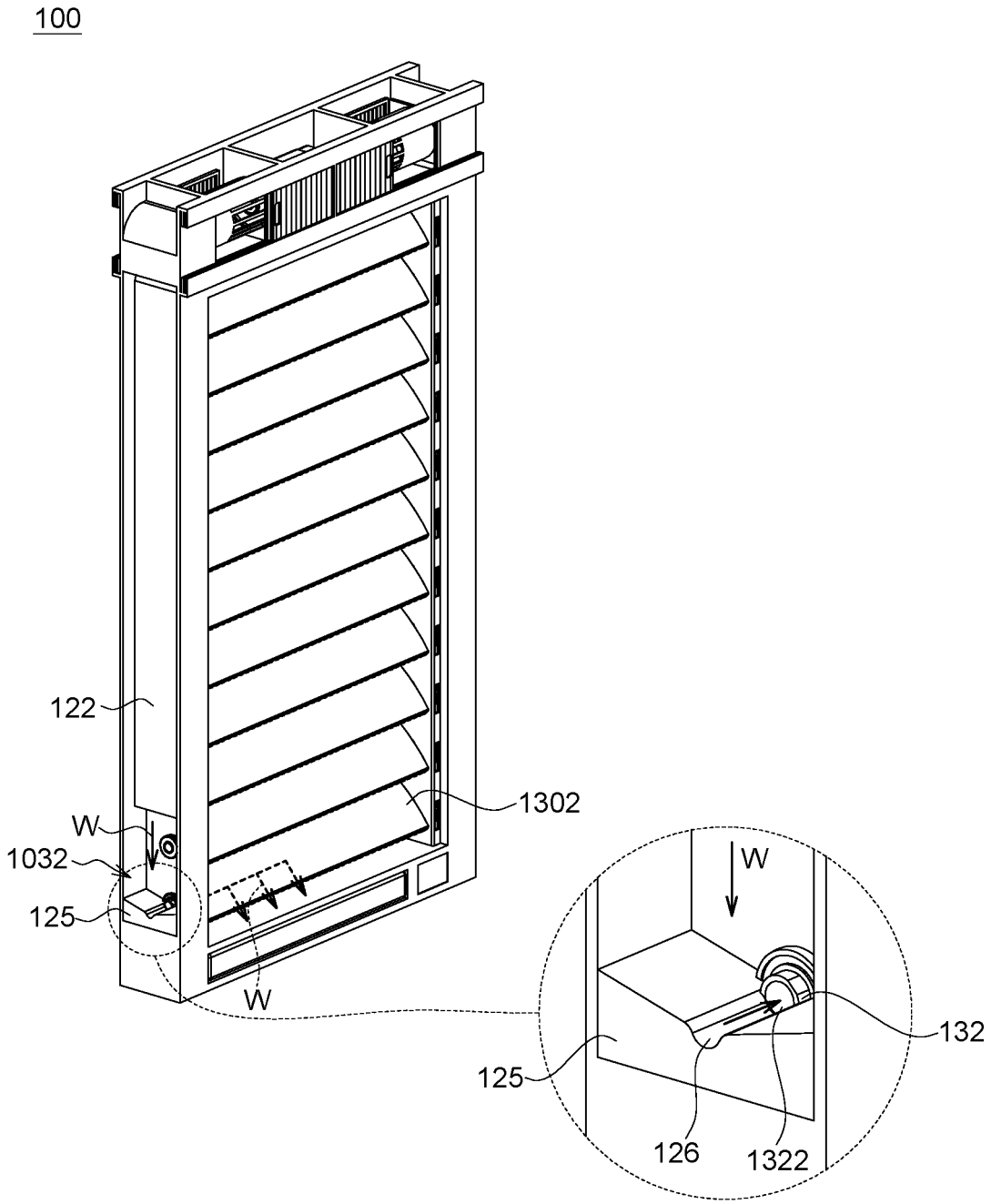
FIG. 7 is a schematic diagram and a partial enlargement of a water collecting groove (for collecting rainwater) and a drainage channel according to an embodiment of the present invention.

FIG. 7 is a schematic diagram and a partial enlargement of a water collecting groove 125 for collecting the condensed water in the airflow (for example, the rainwater absorbed by the intake driving unit 110) and a drainage channel 126 according to an embodiment of the present invention. Refer to FIGS. 5B and 7. According to an embodiment of the present invention, when the inlet gas containing moisture W is introduced to the left frame portion 103 and the right frame portion 104, the moisture W can move downwards along the outer side of the first partition plate 122 and the second partition plate 124 to be condensed and collected at the underneath of the first partition plate 122 and the second partition plate 124. Since the specific weight of the water is larger than that of the air, the water will be settled and therefore unlikely enter the airflow rising chambers 1033 and 1043, and only dry air can rise and enter each blade structure 130. Thus, the moisture W will be separated from the air. In an embodiment, the bottom of the airflow turning chamber 1032 includes a water collecting groove 125, such as a V-shaped groove. When a large volume of rainwater infiltrates to the upper frame portion 101 and enters the left frame portion 103 or the right frame portion 104, the infiltrating rainwater will be collected at the water collecting groove 125 and drained to the outdoors via the drainage channel 126 which communicates with the water collecting groove 125. In an embodiment, the drainage channel 126 communicates with the through holes 1322 in the bottommost blade structure 1302. The rainwater can thus reach the main channel 133 and the branch channels 134 via the through holes 1322 to be drained to the outdoors.

Figure 8C:
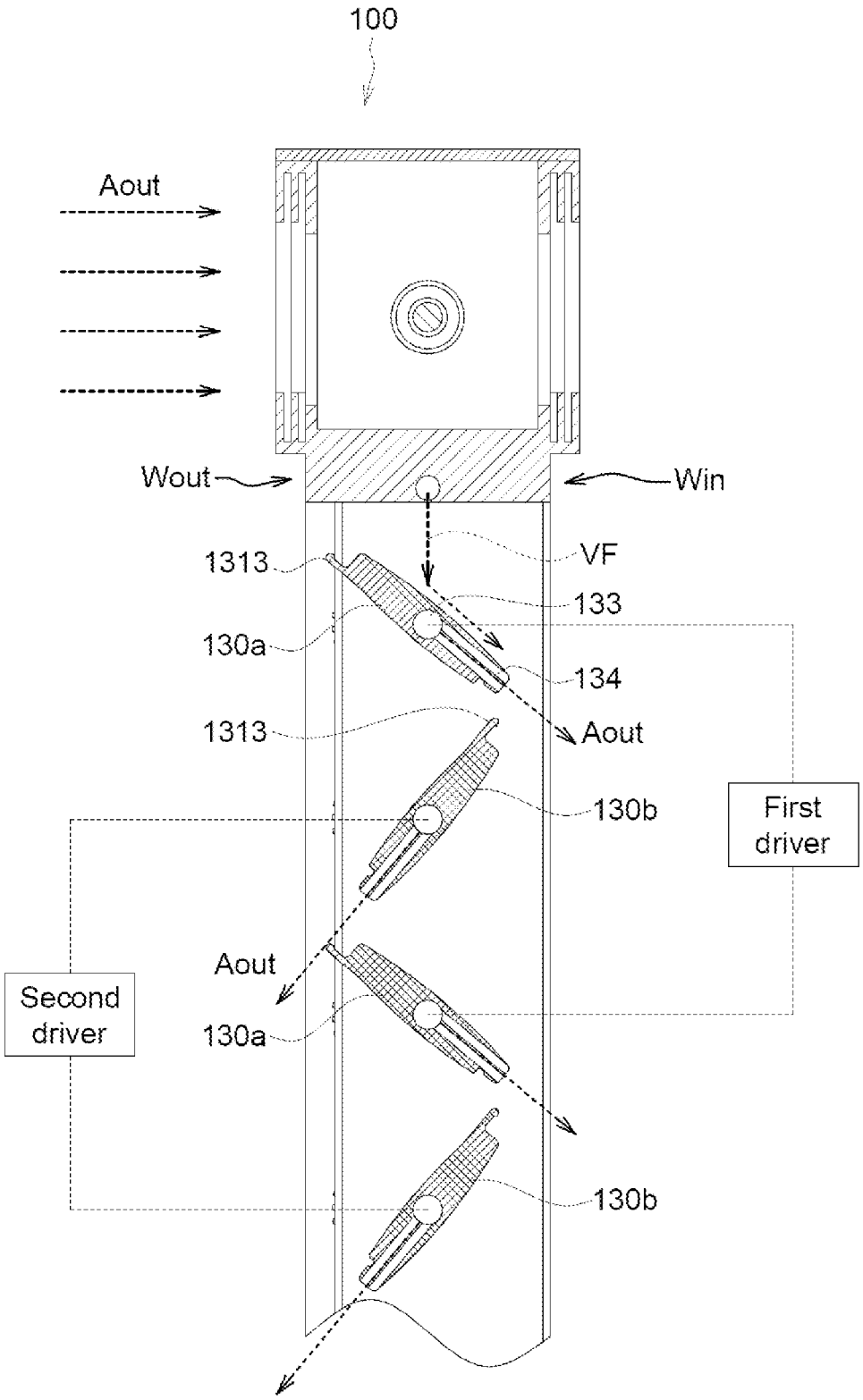
FIG. 8C is a schematic diagram of some blade structures dissipating the air to the outdoors and some other blade structures infusing the air to the indoors according to an embodiment of the present invention.
Figure 8D:
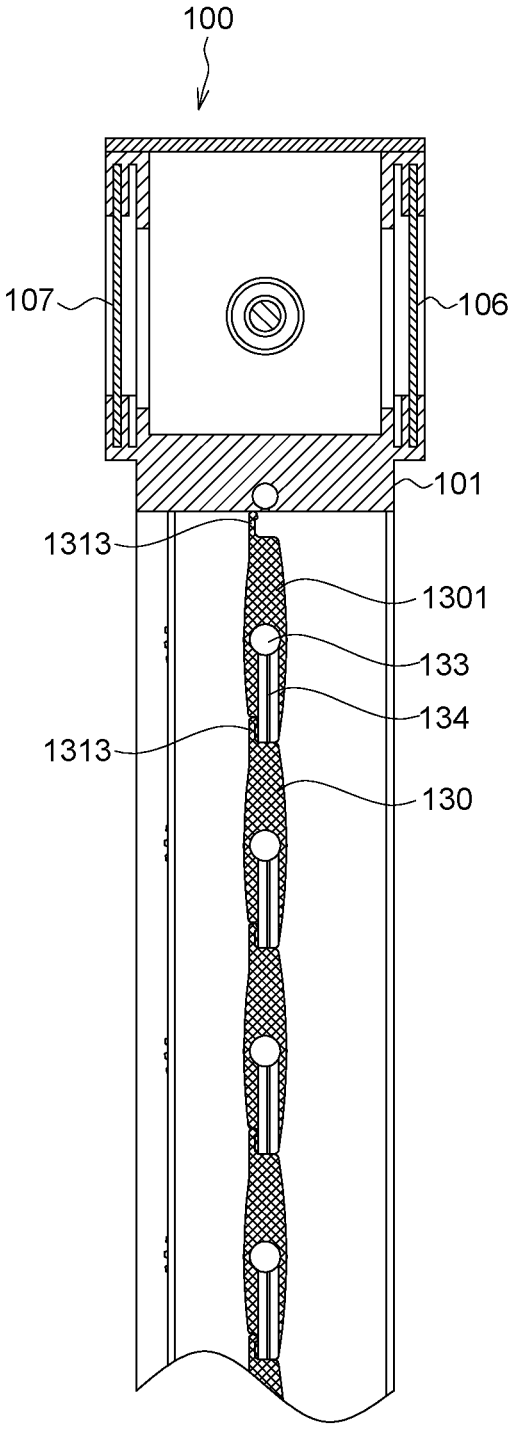
FIG. 8D is a schematic diagram of the blade structures being shut down to block heavy rain and strong winds according to an embodiment of the present invention.

FIG. 8A is a schematic diagram of a dissipation mode in which the indoor air is dissipated to the outdoors to prevent the infiltration of rainwater and insects according to an embodiment of the present invention. FIG. 8B is a schematic diagram of an infusing mode in which the outdoor air is infused to the indoors according to an embodiment of the present invention. FIG. 8C is a schematic diagram of some blade structures 130*a* dissipating the air to the outdoors and some other blade structures 130*b* infusing the air to the indoors under the condition that only the outdoor air is introduced to the shutter according to an embodiment of the present invention. FIG. 8D is a schematic diagram of the blade structures 130 being shut down to block heavy rain and strong winds according to an embodiment of the present invention.

Refer to FIGS. 3A and 8A. According to an embodiment of the present invention, when the shutter 100 is in a dissipation mode, the indoor air Ain enters the upper frame portion 101 via the interior air inlet 1051 of the inner window side Win, and the blade driving unit drives the blade structures 130 to face the outdoors to dissipate the indoor air Ain. Meanwhile, the indoor air Ain will be forced to dissipate to the outdoors. This design replaces the conventional design of installing a fan on the window to dissipate the air to the outdoors. Additionally, the dissipated airflow forms an air-wall which effectively prevents the outdoor rainwater and insects from entering the indoors, and provides even better prevention against the infiltration of rainwater and insects.

In an embodiment, the blade driving unit can determine whether to enter the dissipation mode according to the detection results of an indoor/outdoor sensor 150. Thus, automatic adjustment ca be achieved. In an embodiment, the vertical airflow VF can be dissipated to the outdoors in the dissipation mode.

Refer to FIGS. 3C and 8B. According to an embodiment of the present invention, when the shutter 100 is in an infusing mode, the outdoor air Aout can enter the upper frame portion 101 via the exterior air inlet 1052 of the outer window side Wout, and the blade driving unit drives the blade structures 130 to face the indoors to infuse the outdoor air Aout. Meanwhile, the design of infusing the outdoor air Aout to the indoors replaces the conventional deign of installing a fan on the window to infuse the air to the indoors. Particularly, when the $CO_2$ concentration of the indoor air Ain or the indoor temperature is too high, the infused outdoor air Aout can effectively reduce the indoors $CO_2$ concentration and temperature. Additionally, if the shutter 100 adopts the exchanging mode of 50% of the indoor air and 50% of the outdoor air as indicated in FIG. 3B, then the blade structures 130 face the indoors to infuse the outdoor air Aout to the indoors and the purpose of concurrently filtering the indoor air and infusing the fresh outdoor air to the indoors can be achieved.

In an embodiment, the blade driving unit can determine whether to enter the infusing mode according to the detection results of an indoor/outdoor sensor 150. Thus, automatic adjustment can be achieved. In an embodiment, the vertical airflow VF can be infused to the indoors in the infusing mode.

Refer to FIGS. 3C and 8C. According to an embodiment of the present invention, when the shutter 100 executes the infusing mode, the blade driving unit drives some blade structures 130*a* to face the indoors so that the outdoor air Aout can be infused to the indoors and drives some other blade structures 130*b* to face the outdoors such that the outdoor air Aout can be dissipated to form an air wall to prevent the infiltration of rainwater and insects. The blade driving unit includes a first driver (not illustrated) and a second driver (not illustrated). The first driver connects the odd-numbered blade structures 130*a* for driving the odd-numbered blade structures 130*a* to face the indoors or the outdoors, and the second driver connects the even-numbered blade structures 130*b* for driving the even-numbered blade structures 130*b* to face the indoors or the outdoors. The first driver and the second driver can independently control the angles and positions of the blade structures 130*a* and 130*b*. Thus, through the above arrangement, the outdoor air Aout can be dissipated to the outdoors to form the air wall which prevents rainwater or insects from entering the indoors. Furthermore, under the condition that the illumination is sufficient, the outdoor air Aout can be infused to the indoors to effectively reduce the indoor $CO_2$ concentration and temperature.

In an embodiment, the first driver and the second driver include structures such as turntable, connecting rod, lead screw or cam, and rack and pinion, but are not limited thereto. Through the combination of the said structures and the motor, the blade structures 130 can be rotated to predetermined positions, such that the shutter 100 can be switched to different operation modes. Additionally, the odd-numbered blade structures 130*a* and the even-numbered blade structures 130*b* are separately driven, such that the gap between the blades can be increased and the blades can be successfully swung to predetermined positions without being blocked by the extension unit 1313 of another blade. In an embodiment, the extension unit 1313 and the blade can be integrally formed of the same material in one piece. The extension unit 1313 can also be realized by an elastomer. When the elastomer collides with an object, the elastomer will bend but will not break.

Refer to FIG. 8D. According to an embodiment of the present invention, when there are heavy rain and strong winds outside or when no one is at home, the shutter 100 can be shut down to prevent the infiltration of rainwater, winds and burglars. In an embodiment, when the shutter 100 is in a shut-down state, the blade structures 130 are arranged along a straight line from the upper frame portion 101 to the lower frame portion 102, and two adjacent blade structures 130 tightly contact each other by two adjacent surfaces to enter a closed state. Since the outdoor rain and winds do not enter the indoors via the gap, a better protection effect is achieved. Since the burglars cannot spy the indoors via the gaps, privacy can be secured, the outdoor air can be infused to the indoors, and the indoor air can be filtered at the closed state.

Figure 9A:
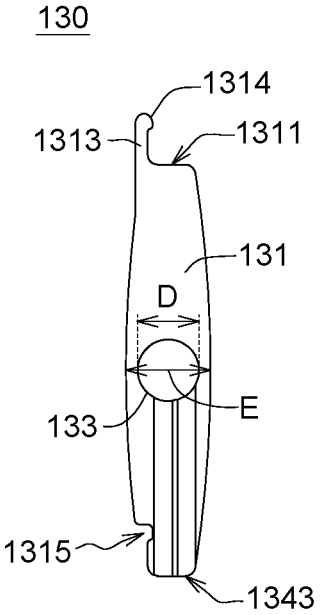
FIG. 9A is a side view of a blade structure according to an embodiment of the present invention.
Figure 9B:
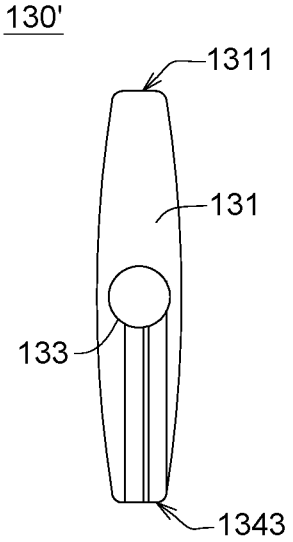
FIG. 9B is a side view of a blade structure according to another embodiment of the present invention.

FIG. 9A is a side view of a single blade structure 130 according to an embodiment of the present invention. FIG. 9B is a side view of a single blade structure 130' according to another embodiment of the present invention.

Refer to FIGS. 8D and 9A. According to an embodiment of the present invention, two opposite surfaces of each blade structure 130 respectively have an extension unit 1313 and a groove 1315. The shape of the extension unit 1313 matches that of the groove 1315. The groove 1315 is disposed on one side of the blade body 131 closer to the outlet 1343, and the extension unit 1313 is disposed on one side of the blade body 131 farther away from the outlet 1343. In an embodiment, the extension unit 1313 extends from the second side surface 1311 of the blade body 131. The extension unit 1313 can be realized by an elastomer formed of rubber, plastics or other elastic material. The extension unit 1313 can be integrally formed of the same material with the blade body 131 in one piece, or can be formed of other materials added thereto. Moreover, the extension unit 1313 has a hook structure 1314 whose shape matches that of the groove 1315. As indicated in FIG. 8D, when the blade structures 130 are arranged along a straight line from the upper frame portion 101, the shape of the extension unit 1313 of one of the blade structures 130 and the groove 1315 of an adjacent blade structure 130 have corresponding shapes and are engaged with each other to enter a closed state. Furthermore, the extension unit 1313 of the topmost blade structure 1301 can lean on the bottom of the upper frame portion 101 to enter a closed state.

Additionally, the thickness of the blade body 131 diminishes to the two sides from the central part (the main channel 133), such that the center of the blade body 131 has a largest thickness E; meanwhile, the main channel 133 passing through the central part of the blade body 131 has a larger aperture D.

Refer to FIG. 9B. According to an embodiment of the present invention, the structure of the blade body 131 can be dispensed with the extension unit 1313 and the groove 1315, and two adjacent blade structures 130' tightly contact each other by two adjacent second side surfaces 1311 to enter a closed state.

Figure 10A:
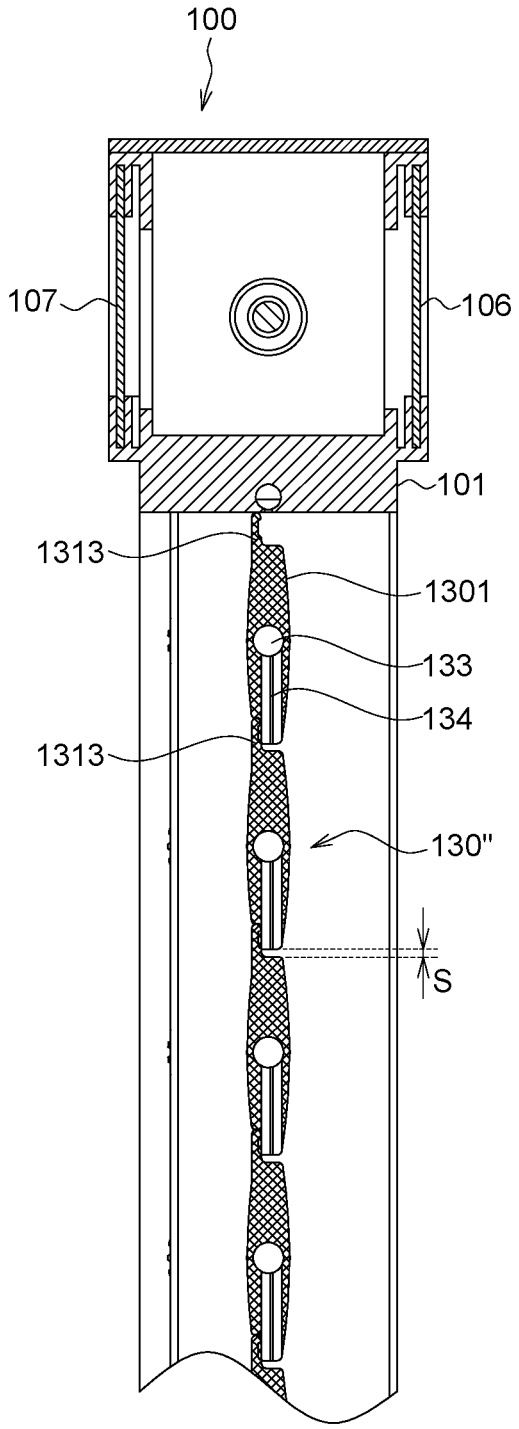
FIG. 10A is a schematic diagram of the blade structures being shut down to block heavy rain and strong winds according to another embodiment of the present invention.
Figure 10B:
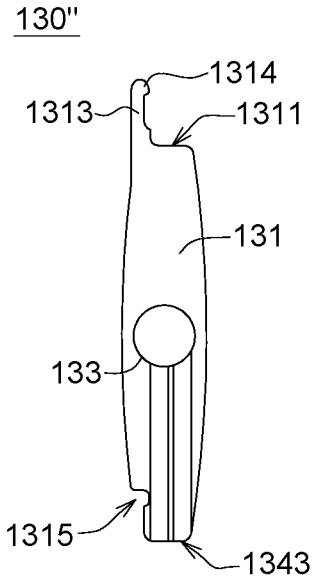
FIG. 10B is a side view of a blade structure according to an alternate embodiment of the present invention.

FIG. 10A is a schematic diagram of the blade structures 130" being shut down to block heavy rain and strong winds according to another embodiment of the present invention. FIG. 10B is a side view of a single blade structure 130" according to an alternate embodiment of the present invention. Refer to FIGS. 10A and 10B. The blade structures 130" is different from the blade structures 130 in that: the length of the extension unit 1313 slightly increases, and a gap height is reserved between the lower edge of the extension unit 1313 and the second side surface 1311, such that when two adjacent blade structures 130" of FIG. 10A overlap, a gap S is formed, and the outlets 1343 of the branch channels 134 are exposed. When the shutter 100 is in a shut-down state, the outdoor air still can flow to the gap S via the outlets 1343 of the branch channels 134, such that the shutter 100 still can infuse the outdoor air to the indoors and block the infiltration of rainwater and insects.

As indicated in FIGS. 9A-9B and FIGS. 10A-10B, viewing from the side surface, the axis of the branch channels slightly deviates from the central line of the blade structures. However, the present invention is not limited thereto, and the axis of the branch channels can be aligned with the central line of the blade structures, and such implementations are still within the scope of protection of the present invention.

The shutter and the blade structures disclosed in above embodiments of the present invention can avoid the infiltration of rainwater and insects. In comparison to the conventional design of installing a screen window to prevent the insects or installing a fan to increase the ventilation effect, the shutter of the present invention provides multiple functions and better effects without blocking the view and spoiling the aesthetics of the building.

While the invention has been described by example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A shutter, comprising:

a window frame having an upper frame portion, a lower frame portion and two side frame portions;

a plurality of blade structures movably disposed on the frame and each having a through hole and a plurality of outlets;

an intake driving unit disposed in the upper frame portion; and an airflow guiding unit disposed in at least one of the two side frame portions, wherein the at least one of the two side frame portions comprises an airflow sinking chamber, an airflow turning chamber and an airflow rising chamber, and the airflow turning chamber located on a bottom of the window frame and connects the airflow sinking chamber and the airflow rising chamber and the airflow turning chamber comprises a water collecting groove and a drainage channel;

wherein each of the through holes of the blade structures communicates with the inside of the at least one of the two side frame portions;

wherein in the same side frame portion, the airflow rising chamber is closer to the blade structures than the airflow sinking chamber, and the airflow turning chamber connects a lower portion of the airflow rising chamber with a lower portion of the airflow sinking chamber.

2. The shutter according to claim 1, wherein the upper frame portion comprises at least one exterior air inlet and at least one interior air inlet.

3. The shutter according to claim 1, wherein the upper frame portion comprises at least one movable door panel.

4. The shutter according to claim 1, wherein the upper frame portion comprises a sealed chamber and at least one intake regulating chamber.

5. The shutter according to claim 1, wherein the airflow guiding unit comprises at least one partition plate extending downwards in the at least one of the two side frame portions for separating the airflow sinking chamber from the airflow rising chamber.

6. The shutter according to claim 1, further comprising a vertical type airflow guiding unit interposed between the upper frame portion and a topmost one of the blade structures, wherein the vertical type airflow guiding unit communicates with the airflow rising chamber, such that an inlet gas enters the vertical type airflow guiding unit via the airflow rising chamber.

7. The shutter according to claim 1, further comprising a blade driving unit connecting the blade structures.

8. The shutter according to claim 7, wherein the blade driving unit comprises a first driver and a second driver.

9. The shutter according to claim 8, wherein odd-numbered blade structures are connected to the first driver, and even-numbered blade structures are connected to the second driver to actuate alternating blade structures.

10. The shutter according to claim 1, further comprising a plurality of regulators disposed on the blade structures.

11. The shutter according to claim 1, wherein when the blade structures are arranged along a straight line from the upper frame portion to the lower frame portion, adjacent two of the blade structures tightly contact each other by two adjacent surfaces to enter a closed state.

12. The shutter according to claim 1, wherein adjacent two of the blade structures respectively have an extension unit and a groove, and the extension unit and the groove have matching shapes and are engaged with each other.

13. The shutter according to claim 12, wherein when the blade structures are arranged along a straight line from the upper frame portion to the lower frame portion, a gap is formed between every adjacent two of the blade structures.

14. The shutter according to claim 1, wherein each of the at least one of the two side frame portions comprises the airflow sinking chamber, the airflow turning chamber and the airflow rising chamber.

15. The shutter according to claim 1, wherein the airflow turning chamber is exposed from an outer surface of the corresponding side frame.

* * * * *